US012674454B2

(12) United States Patent
Korte et al.

(10) Patent No.: US 12,674,454 B2
(45) Date of Patent: Jul. 7, 2026

(54) PUMP WITH PRESSURE DISC

(71) Applicant: ITT Bornemann GmbH, Obernkirchen (DE)

(72) Inventors: Eike Steffen Korte, Obernkirchen (DE); David Johannes Blatt, Obernkirchen (DE)

(73) Assignee: ITT Bornemann GmbH, Obernkirchen (DE)

( * ) Notice: Subject to any disclaimer, the term of this patent is extended or adjusted under 35 U.S.C. 154(b) by 0 days.

(21) Appl. No.: 18/963,297

(22) Filed: Nov. 27, 2024

(65) Prior Publication Data

US 2025/0180015 A1 Jun. 5, 2025

(30) Foreign Application Priority Data

Dec. 4, 2023 (DE) ..... 102023133839.0

(51) Int. Cl.
*F04C 15/00* (2006.01)
*F04C 2/16* (2006.01)

(52) U.S. Cl.
CPC ..... *F04C 15/00* (2013.01); *F04C 2/16* (2013.01); *F04C 15/0038* (2013.01); *F04C 2240/50* (2013.01); *F04C 2240/60* (2013.01)

(58) Field of Classification Search
CPC ..... F04C 15/00; F04C 2/16; F04C 15/0038; F04C 2240/50; F04C 2240/60
See application file for complete search history.

(56) References Cited

U.S. PATENT DOCUMENTS 1,677,980 A * 7/1928 Montelius ..... F04C 2/16 418/203
2,757,897 A 8/1956 Cline
3,932,073 A * 1/1976 Schibbye ..... F01C 1/16 418/203
4,017,223 A * 4/1977 Blackwell ..... F04C 15/0042 418/203
4,212,543 A 7/1980 Bersano
(Continued)

FOREIGN PATENT DOCUMENTS

AT 342 423 B 4/1978
CN 108180140 A 6/2018
(Continued)

OTHER PUBLICATIONS

Foreign Patent Publication and Machine Translation of Chinese Patent CN 111686493 A, 1st Inventor: Wang, Title: A Municipal Sewage Filtering Device, Published: Sep. 22, 2020. (Year: 2020).*

*Primary Examiner* — Mary A Davis
(74) *Attorney, Agent, or Firm* — VIA LLP

(57) ABSTRACT

A pump for conveying a medium having a suction-side inlet, a pressure-side outlet, a suction chamber, a conveyance housing. The conveyance housing having a pressure chamber in which there is a prevailing pressure chamber pressure, and a carrier shaft arranged in the conveyance housing on which a transport element is arranged for conveying the medium along a direction of conveyance from the suction chamber into the pressure chamber. A pressure disc is arranged in an axially fixed manner on the carrier shaft, wherein one side of the pressure disc is fluidly connected to the pressure chamber and exposed to a compressive force acting in the direction of conveyance.

18 Claims, 8 Drawing Sheets

(56) References Cited

U.S. PATENT DOCUMENTS

| | | | | |
|---|---|---|---|---|
| 4,744,669 | A | 5/1988 | Kowalczyk et al. | |
| 4,824,348 | A * | 4/1989 | Winyard | F01C 3/08 418/196 |
| 5,018,952 | A * | 5/1991 | Winyard | F01C 3/08 418/196 |
| 5,083,506 | A | 1/1992 | Horn et al. | |
| 5,372,418 | A | 12/1994 | Biesenberger et al. | |
| 6,186,655 | B1 | 2/2001 | Brookes et al. | |
| 6,298,751 | B1 | 10/2001 | Ide et al. | |
| 6,685,453 | B2 | 2/2004 | Oehman, Jr. et al. | |
| 7,017,732 | B2 | 3/2006 | Uphus | |
| 7,862,315 | B2 | 1/2011 | Rohlfing et al. | |
| 8,764,424 | B2 | 7/2014 | Kirkland | |
| 9,630,345 | B2 | 4/2017 | Alsewailem | |
| 10,486,383 | B1 | 11/2019 | Allard et al. | |
| 10,731,082 | B2 | 8/2020 | Tenore et al. | |
| 11,241,026 | B2 | 2/2022 | Wenger et al. | |
| 2005/0219943 | A1 | 10/2005 | Ltd | |
| 2007/0274842 | A1 | 11/2007 | Campen et al. | |
| 2011/0158841 | A1 | 6/2011 | Liu et al. | |
| 2013/0156545 | A1 | 6/2013 | Britsch | |
| 2017/0254328 | A1 | 9/2017 | Rohlfing et al. | |
| 2021/0355938 | A1 | 11/2021 | Trossmann et al. | |

FOREIGN PATENT DOCUMENTS

| | | | |
|---|---|---|---|
| DE | 35 20 994 | A1 | 1/1986 |
| DE | 4416077 | A1 | 11/1995 |
| DE | 19502173 | A1 | 8/1996 |
| DE | 19820523 | A1 | 11/1999 |
| DE | 19829195 | A1 | 1/2000 |
| DE | 10162772 | A1 | 7/2003 |
| DE | 10251508 | A1 | 5/2004 |
| DE | 102 57 859 | A1 | 7/2004 |
| DE | 202004018377 | U1 | 4/2005 |
| DE | 102004030123 | B3 | 10/2005 |
| DE | 202009000690 | U1 | 4/2009 |
| DE | 102007060174 | A1 | 6/2009 |
| DE | 102010038863 | A1 | 2/2012 |
| DE | 202013000913 | U1 | 5/2014 |
| DE | 102016120579 | B3 | 4/2018 |
| DE | 10 2018 130 472 | A1 | 6/2020 |
| DE | 102021101111 | A1 | 7/2022 |
| DE | 102021208481 | A1 | 2/2023 |
| EP | 3913187 | A1 | 11/2021 |
| WO | WO 2014/019687 | A2 | 2/2014 |

* cited by examiner

PUMP WITH PRESSURE DISC

CROSS REFERENCE TO RELATED APPLICATION

Any and all applications for which a foreign or domestic priority claim is identified in the Application Data Sheet of the present application are hereby incorporated by reference in their entireties under 37 CFR 1.57. This application claims the priority benefit of German Application No. 10 2023 133 839.0 filed Dec. 4, 2023, the entirety of which is incorporated herein by reference.

BACKGROUND

Technical Field

The present application relates to a pump for conveying a medium having a suction-side inlet, a pressure-side outlet, a suction chamber, and a conveyance housing. The conveyance housing having a pressure chamber in which there is a prevailing pressure chamber pressure, and a carrier shaft. The carrier shaft arranged in the conveyance housing on which a transport element is arranged for conveying the medium along a direction of conveyance from the suction chamber into the pressure chamber.

Brief Description of Related Art

Pumps are used across various industries to transport mediums with differing viscosities and compositions. However, pumps often face issues achieving desired delivery rates.

SUMMARY

In some aspects, the techniques described herein relate to a pump including: a suction-side inlet; a pressure-side outlet; a suction chamber; a conveyance housing including a pressure chamber, wherein the pressure chamber operates at a first pressure; a carrier shaft positioned in the conveyance housing; a transport element connected to the carrier shaft, wherein the transport element is configured to convey a medium from the suction chamber into the pressure chamber; and a pressure disc, wherein the pressure disc is axially fixed to the carrier shaft, wherein a side of the pressure disc is fluidly connected to the pressure chamber and exposed to a compressive force acting in a direction of conveyance.

In some aspects, the techniques described herein relate to a pump, wherein a side of the pressure disc distal to the pressure chamber is fluidly connected to a rear chamber, wherein the rear chamber operates at a second pressure that is less than the first pressure.

In some aspects, the techniques described herein relate to a pump, wherein the rear chamber is fluidly connected to the suction chamber.

In some aspects, the techniques described herein relate to a pump, wherein a slide bearing is positioned between the pressure disc and the conveyance housing.

In some aspects, the techniques described herein relate to a pump, wherein the pressure disc includes a shoulder.

In some aspects, the techniques described herein relate to a pump, wherein the slide bearing is positioned between the shoulder of the pressure disc and the conveyance housing.

In some aspects, the techniques described herein relate to a pump, wherein a pressure ring positioned radially between the pressure disc and the conveyance housing, the pressure ring supported by a side of the shoulder of the pressure disc proximal to the pressure chamber.

In some aspects, the techniques described herein relate to a pump, wherein the pressure disc is positioned on the carrier shaft and connected to the carrier shaft in a friction-locking, positively-locking, and/or materially-locking manner.

In some aspects, the techniques described herein relate to a pump, wherein the pressure disc and the carrier shaft are molded as one piece.

In some aspects, the techniques described herein relate to a pump, wherein the carrier shaft is partially positioned outside of the pressure chamber within a bearing housing, wherein the bearing housing is fixed to the conveyance housing.

In some aspects, the techniques described herein relate to a pump, wherein the pump further includes a plurality of carrier shafts, wherein each carrier shaft of the plurality of carrier shafts is connected to a corresponding transport element and pressure disc.

In some aspects, the techniques described herein relate to a pump, wherein a first pressure disc and a second pressure disc each include a shoulder and are adjacent pressure discs, and wherein the shoulder of the first pressure disc radially overlaps the shoulder of the second pressure disc in an overlapping region of the first pressure disc and the second pressure disc.

In some aspects, the techniques described herein relate to a pump, wherein the pump is a single-fluted mandrel screw spindle pump.

In some aspects, the techniques described herein relate to a pump, wherein the pressure disc is positioned in the direction of conveyance behind the transport element and the side of the pressure disc proximal to the pressure chamber is fluidly connected to the pressure chamber.

In some aspects, the techniques described herein relate to a pump including: a suction-side inlet; a pressure-side outlet; a suction chamber; a conveyance housing including a pressure chamber; a carrier shaft positioned in the conveyance housing; a threaded fluid transport rotatably connected to the carrier shaft, the threaded fluid transport fluidly connected to the suction chamber and the pressure chamber to convey a fluid from the suction chamber into the pressure chamber upon rotation of the threaded fluid transport; and a pressure disc arranged with the carrier shaft extending therethrough, such that a side of the pressure disc is fluidly connected to the pressure chamber and exposed to a compressive force.

In some aspects, the techniques described herein relate to a pump, wherein a side of the pressure disc distal to the pressure chamber is fluidly connected to a rear chamber, wherein the rear chamber operates at a second pressure that is less than a first pressure corresponding to the pressure chamber.

In some aspects, the techniques described herein relate to a pump, wherein the rear chamber is fluidly connected to the suction chamber.

In some aspects, the techniques described herein relate to a pump, wherein the pump further includes a plurality of carrier shafts, wherein each carrier shaft of the plurality of carrier shafts is connected to a corresponding transport element and pressure disc.

In some aspects, the techniques described herein relate to a pump, wherein the pump further includes a plurality of pressure rings that are positioned radially between the corresponding pressure disc and the conveyance housing, the pressure rings supported by a side of a shoulder of the corresponding pressure disc proximal to the pressure chamber.

In some aspects, the techniques described herein relate to a pump, wherein the pump further includes a pressure ring configured as a double ring that corresponds to at two pressure discs.

BRIEF DESCRIPTION OF THE DRAWINGS

The drawings include the following Figures, which are not necessarily drawn to scale.

Figure 1:
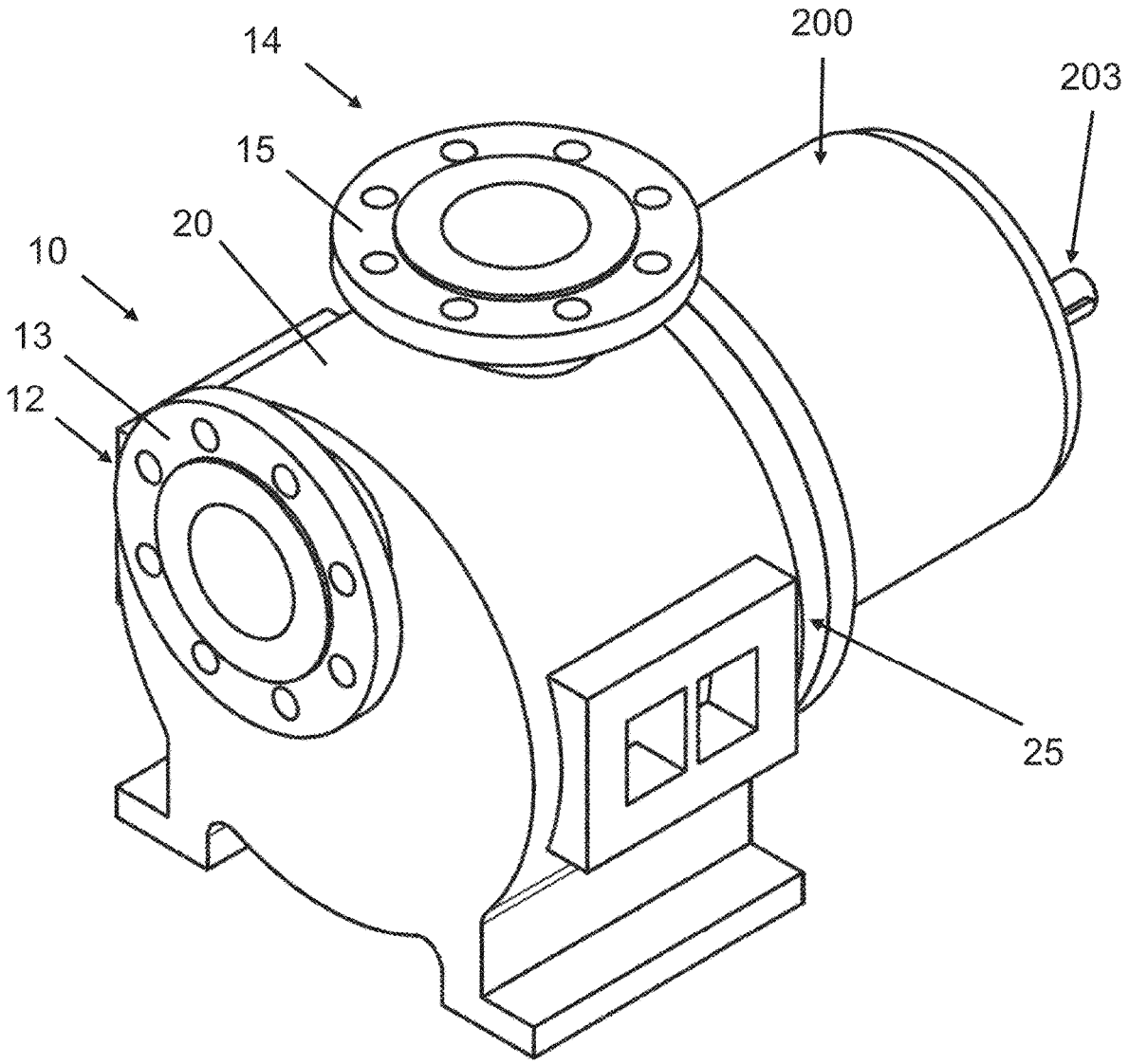
FIG. 1 illustrates a perspective view of a pump according to some embodiments.

The drawing includes examples of possible implementations; and the scope of the invention is not intended to be limited to the implementations shown therein. For example, the scope of the invention is intended to include, and embodiments are envisioned using, other implementations besides, or in addition to, that shown in the drawing, which may be configured within the spirit of the underlying invention disclosed in the present application as a whole.

DETAILED DESCRIPTION

Pumps can be used to perform various tasks and can have various designs. For example, DE 102 57 859 A1 describes a two-spindle screw pump in one-flow design, with an external bearing of the two screw spindles.

During pump operation, very high axial forces may occur, for example in the case of single-fluted mandrel screw spindle pumps. In contrast to double-fluted mandrel screw spindle pumps, in the case of single-fluted mandrel screw spindle pumps, the conveyance-based axial forces cannot be compensated by a counter-fluted arrangement. On the suction side, for example, there is a pressure that corresponds to approximately the ambient pressure, while on the pressure side, for example, there may be pressures of up to 25 bar. Thus, correspondingly large surface loads are exerted on the mandrel screw spindles on the pressure side, which must be absorbed using axial bearings.

At high speeds of the transport elements, the high pressures can lead to substantial wear on the axial bearings. While bearings can in some cases be regularly inspected and replaced, this can result in high maintenance costs.

The present application discloses a pump that, among providing other benefits, advantageously reduces wear on the axial bearings and reduces maintenance costs. In some embodiments, the pump for conveying a medium may have a suction-side inlet, a pressure-side outlet, a suction chamber, and a conveyance housing. The conveyance housing may have a pressure chamber at a first pressure, and a carrier shaft positioned in the conveyance housing. A transport element may be positioned on the carrier shaft for conveying the medium along a direction of conveyance from the suction chamber into the pressure chamber. Additionally, or alternatively, a pressure disc may be positioned in an axially fixed manner on the carrier shaft. In some embodiments, one side of the pressure disc may be fluidly connected to the pressure chamber and exposed to a compressive force acting in the direction of conveyance.

When the pressure chamber is pressurized, a force may be exerted on the pressure disc that is counter to the force that the pressure chamber pressure imparts on the transport element. In some embodiments, the effective axial load of the carrier shaft is minimized or eliminated, so that no inefficient over-sizing of the axial bearing of the carrier shaft is required. Advantageously, the wear on the axial bearing of the carrier shaft is reduced, thus reducing the maintenance cost of the pump. In some embodiments, the compressive force acting on the pressure disc in the direction of conveyance along the transport element is imparted by the conveyed medium. In some embodiments, the axial force spikes are sufficiently reduced or eliminated by the pressure disc, so that the remaining axial force spikes can be sufficiently absorbed by radial bearings.

Additionally, or alternatively, a side of the pressure chamber facing away from the pressure disc may be fluidly connected to a rear chamber in which there is a second pressure (e.g., a rear chamber pressure) that is lower than the first pressure (e.g., the pressure chamber pressure). The greater the pressure difference between the pressure chamber pressure and the rear chamber pressure, the greater the relief on the bearing of the carrier shaft(s) in the axial direction.

In some embodiments, a bearing, slide bearing, or a very small gap is formed between the pressure disc and the conveyance housing, so that the pressure disc can rotate together with the carrier shaft. Any type of bearing may be used between different components described in this application. For example, the bearing between the pressure disc and the conveyance housing may be a ball bearing, rolling bearing, thrust roller bearing, double ball bearing, cylindrical roller bearing, filling notch bearing, sleeve bushing bearing, flanged bushing bearing, clenched bushing bearing, etc. The slide bearing between the pressure disc and the conveyance housing may be configured as a radial bearing, wherein no radial forces are absorbed by the radial bearing, and it serves only for guidance. Additionally, or alternatively, the absorption of axial forces by the slide bearing may be reduced or prevented, so that the axial forces provided by the pressure disc are transferred to the carrier shaft to ultimately lead to a reduction of the effective axial load on the carrier shaft.

In some embodiments, the pressure disc comprises a shoulder. The shoulder extends radially outward from a base body of the pressure disc. The bearing or slide bearing may be configured between the shoulder of the pressure disc and the conveyance housing. Advantageously, the shoulder increases the surface influenced by the pressure of the pressure chamber, such that the pressure disc can absorb a greater axial force, resulting in a further reduction in the effective axial load of the carrier shaft. In addition, the rotational resistance of the pressure disc is kept low by the shoulder.

In some embodiment, a pressure ring may be positioned radially between the pressure disc and the conveyance housing and supported on a side of the shoulder of the pressure disc facing the pressure chamber. The pressure ring may serve to further reduce the effective axial load on the carrier shaft. In some embodiments, the pressure ring radially projects over the shoulder of the pressure disc.

Furthermore, a side of the pressure ring facing the pressure chamber may be fluidly connected to the pressure chamber. In some embodiments, a side of the pressure ring facing away from the pressure chamber is fluidly connected to the rear chamber. Alternatively, the side of the pressure ring facing away from the pressure chamber is not fluidly connected to the rear chamber. For example, the side of the pressure ring facing away from the pressure chamber may rest fully against the shoulder of the pressure disc and does not radially project over it.

In some embodiments, a bearing or slide bearing may be configured between the pressure ring and the shoulder of the pressure disc and between the pressure ring and the conveyance housing. In some embodiments, the pressure ring is configured as a sliding ring. Thus, the pressure chamber may advantageously be sealed from the rear chamber via the pressure ring, and the pressure ring can slide along the axial extension of the carrier shaft in the conveyance housing. Due to the pressure acting in the pressure chamber, the pressure ring may engage with the shoulder of the pressure disc.

In some embodiments, the bearing or slide bearing between the pressure ring and the conveyance housing may be a radial bearing and the bearing or slide bearing between the pressure ring and the shoulder of the pressure disc may be an axial bearing. The bearing or slide bearing between the pressure ring and the conveyance housing allows an axial movement of the pressure ring, such that the axial forces may be transferred by the slide bearing formed as the axial bearing between the pressure ring and the shoulder of the pressure disc. As a result, the axial forces acting on the pressure ring due to the pressure of the pressure chamber may be effectively transferred to the pressure disc, so that there is a further reduction of the effective axial load on the carrier shaft.

In some embodiments, the pressure disc may be attached to the carrier shaft via a friction-locking, positively-locking, and/or materially-locking manner. For example, the pressure disc may be connected to the carrier shaft via a feather key, a feather gearing, an interference fit, gluing, soldering, welding, etc. Alternatively, the pressure disc may be molded in one piece with the carrier shaft. This may contribute to increased robustness and longevity of the pump.

In some embodiments, the rear chamber may be fluidly connected to the suction chamber. For example, a recirculation line can be positioned between the rear chamber and the suction chamber, via which the medium is supplied to the suction chamber. In some embodiments, the rear chamber pressure may be a negative pressure. For example, the pressure of the rear chamber may be less than the pressure of the pressure chamber or the surrounding environment. In some embodiments, the medium, which enters the rear chamber due to leakage, may be advantageously re-supplied to the compression process to prevent any loss of medium. In some embodiments, the rear chamber pressure can correspond to an ambient pressure. Advantageously, having the rear chamber be at the ambient pressure allows for a simple construction of the rear chamber, because no special sealing may be required. The rear chamber may have an opening via which the rear chamber may be fluidly connected to the environment. In some embodiments, the pressure disc can be fluidly connected to the pressure chamber via a line or channel when the direction of conveyance along the carrier shaft leads away from the pressure disc. To prevent the axial forces on the bearing, the side of the pressure disc facing away from the transport element may be exposed to the conveyed medium from the pressure chamber.

Within the conveyance housing, the carrier shaft may be supported outside the pressure chamber. In some embodiments, the carrier shaft may be supported on the side of the pressure disc facing away from the pressure chamber. Thus, the bearing may be advantageously easier to access, so that maintenance and repairs of the bearing and/or the pump are easier and more efficient.

In some embodiments, the carrier shaft may be supported on at least one axial bearing within the bearing housing. The axial bearing may be a roller bearing. For example, a helical ball bearing, a grooved ball bearing, a cylindrical roller bearing, a needle bearing, a tapered roller bearing, or a spherical roller bearing. Because of potential high axial force spikes, in some embodiments, the carrier shaft may be supported on at least one axial bearing in order to protect the other components of the pump. In addition, axial bearings can help to reduce vibrations of the pump.

In some embodiments, the pump has a plurality of carrier shafts, transport elements, pressure discs, and/or pressure rings. Each carrier shaft may have a corresponding transport element and pressure disc. In some instances, higher flow rates can be achieved with a pump having a plurality of carrier shafts. The higher flow rates may provide more axial pressure and wear on the axial bearings. Thus, the pump embodiments disclosed herein may dramatically reduce the wear on the axial bearings and reduce maintenance costs.

In some embodiments, the pressure discs each comprise a shoulder. The shoulder of one of the pressure discs of two adjacent pressure discs may radially overlap the shoulder of the other pressure disc in an overlapping region. In some embodiments, a bearing or slide bearing may be positioned between adjacent pressure discs in the overlapping region. Thus, some embodiments may prevent or at least reduces leakages between the adjacent pressure discs.

In some embodiments, a pressure ring is provided for each carrier shaft and may be positioned radially between the respective pressure disc and the conveyance housing. The pressure ring may be supported by the shoulder of the corresponding pressure disc. The pressure rings for adjacent pressure discs can each be formed separately or in one piece, for example as a double ring.

In some embodiments, the pump may be a single-fluted mandrel screw spindle pump. The pump may be a single-spindle manner. In some embodiments, the pump may be a multi-spindle manner.

In some embodiments, the pressure disc may be positioned behind, in the direction of conveyance, the transport element. The side of the pressure disc facing the pressure chamber may be fluidly connected to the pressure chamber so that, in the case of a one-sided bearing, the pressure disc absorbs compressive forces in the direction of the drive (e.g., the direction of conveyance) and simultaneously provides a first sealing of the drive against the conveyed medium. In some embodiments, the pressure disc absorbs the majority of the conveyance pressure, without the need to redirect the direction of conveyance of the medium, and transfers it to the carrier shaft. In some embodiments, the pressure disc may be positioned upstream of the transport element. However, a portion of the conveyed medium may then need to be conveyed back through a high-pressure line counter to the direction of conveyance of the transport element in order to pressurize the side of the pressure disc facing away from the transport element.

FIG. 1 illustrates a schematic representation of a pump 10 in the form of a mandrel screw spindle pump according to some embodiments. The pump 10 may have a conveyance housing 20 in which a carrier shaft 30, shown in FIG. 2, may be positioned. In some embodiments, conveyance housing 20 may include a suction-side inlet 12 having an inlet socket 13 and a pressure-side outlet 14 having an outlet socket 15. As shown in FIG. 1, the inlet 12 in the may be positioned laterally on the conveyance housing 20 on an inlet end face and the outlet 14 may be positioned on the top face of the conveyance housing 20. Alternatively, the inlet 12 and the outlet 14 may be positioned on other faces or locations of the pump 10.

In some embodiments, the pump 10 can be connected to upstream and downstream devices via the inlet socket 13 and the outlet socket 15. A bearing housing 200 may be fixed to the side of the conveyance housing 20 opposite the inlet end face. The bearing housing 200 may contain the one-sided bearing of the carrier shaft 30 to support the axial forces and the radial forces of the carrier shaft 30. In some embodiments, out of the end of the bearing housing 200 facing away from the conveyance housing 20, a drive shaft 203 may project out of the bearing housing 200. The drive shaft 203 can be coupled to a drive or a gear in order to drive the carrier shaft 30 and to transport the medium from the inlet 12 to the outlet 14. An intermediate flange 25 or intermediate disc may be positioned between the conveyance housing 20 and the bearing housing 200 and may be configured such that a standard conveyance housing 20 can be coupled to a standard bearing housing 200. The specific construction of the intermediate flange 25 will be explained further below.

Figure 8:
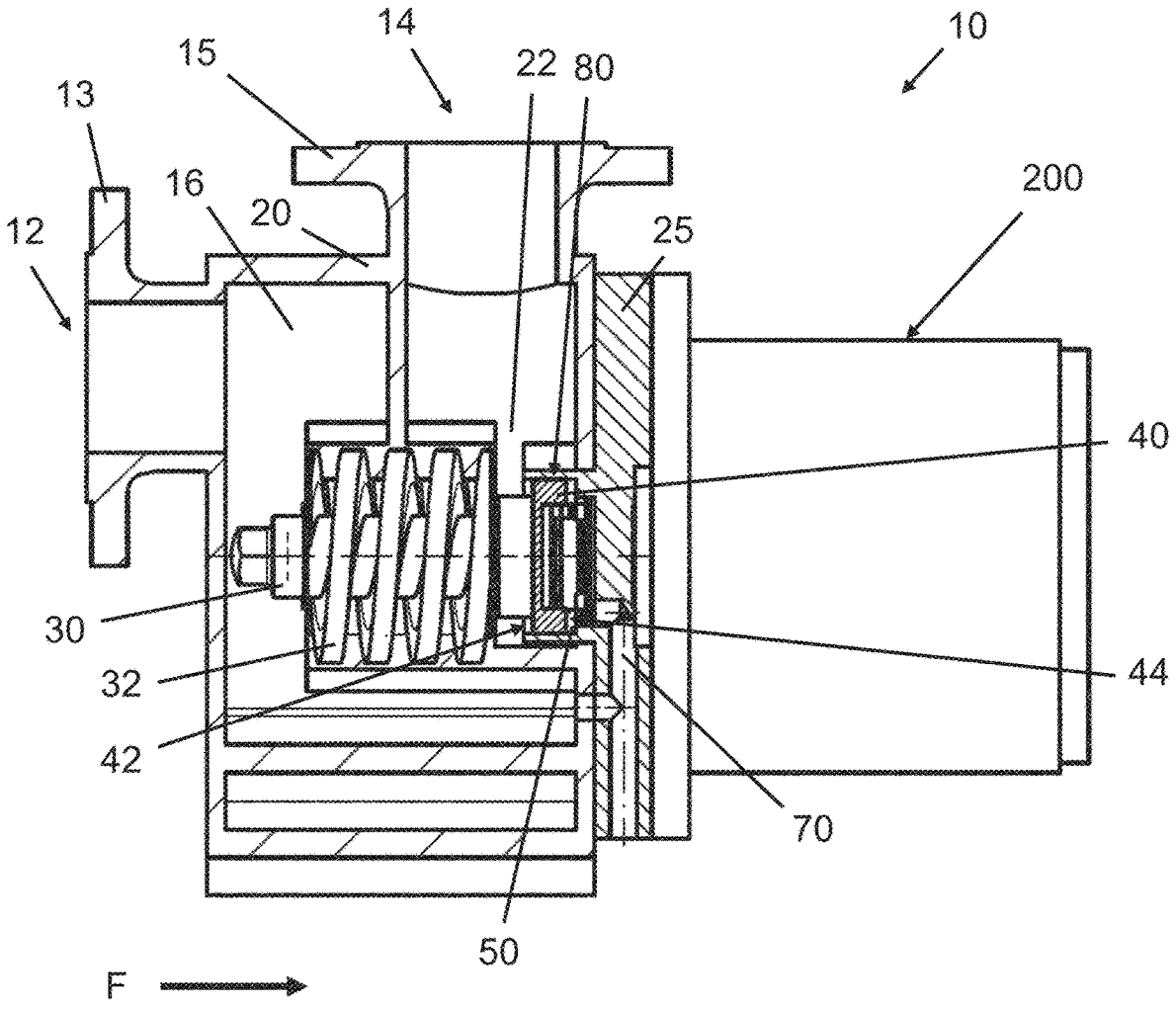
FIG. 8 illustrates a longitudinal cross-section of the pump of FIG. 1, according to some embodiments.

FIG. 8 illustrates a longitudinal cross-section of the conveyance housing 20 of a pump 10 according to FIG. 1. In some embodiments, in the conveyance housing 20, a carrier shaft 30 may be positioned and supported in a rotatable manner. Both axial bearings and radial bearings in the bearing housing 200, which are not shown in cross-section, may be used to support the carrier shaft 30. A transport element 32 may be positioned on the carrier shaft 30, via which a medium may be conveyed along the transport element 32 in a direction of conveyance F. In some embodiments, the transport element 32 may be a mandrel screw spindle. For example, the transport element 32 can be a threaded fluid transport having threadings via which fluid is transported, where the direction of fluid transport depends on the direction of rotation of the transport element 32, which corresponds to the direction of rotation of the carrier shaft 30 to which the transport element 32 is attached. When the direction of rotation of the carrier shaft 30 is reversed, the medium is conveyed in the opposite direction. The transport element 30 may be positioned in a bore or liner within the conveyance housing 20, wherein the inner diameter of the bore or liner substantially corresponds to the outer diameter of the transport element 32.

In some embodiments, the medium enters via the inlet 12 into a suction chamber 16. The suction chamber 16 may be positioned in the conveyance housing 20. Alternatively, the suction chamber 16 may be positioned outside the conveyance housing 20, for example, in a housing surrounding the conveyance housing 20. While the pump 10 is operated, the medium may be conveyed by the transport element 32 from the suction chamber 16 along the carrier shaft 30 in the direction of conveyance F through the bore or liner into a pressure chamber 22 located in the conveyance housing 20. The pressure chamber 22 may be fluidly connected to the outlet 14 such that the medium is conveyed out of the conveyance housing 20 via the outlet 14.

In the pressure chamber 22, there may be a first pressure, which can be, for example, 20, 25, 30, more than 30 bar, or any amount in between. Due to the pressure chamber pressure, the transport element 32 positioned on the carrier shaft 30 may be subjected to a compressive force that is directed against the direction of conveyance F. In some embodiments, in the direction of conveyance F behind the transport element 32, a pressure disc 40 may be positioned and axially fixed on the carrier shaft 30. The pressure disc 40 may be supported in the intermediate flange 25 in a bore or recess. In some embodiments, manufacturing a corresponding bore for the pressure disc on a separately manufactured intermediate flange 25 mounted on an end face of the conveyance housing 20 may be easier than manufacturing a bore inside the conveyance housing 20. The intermediate flange 25 may have a shoulder 251 projecting towards the pressure chamber 22 within which the bore or recess is positioned.

A side 42 (e.g., the proximal side) of the pressure disc 40 facing the pressure chamber 22 is fluidly connected to the pressure chamber 22, and a side 44 (e.g., the distal side) of the pressure disc 40 facing away from the pressure chamber 22 is fluidly connected to a rear chamber 50. The rear chamber 50 has a prevailing rear chamber pressure (e.g., a second pressure) that is lower than the pressure chamber pressure (e.g., a first pressure). In some embodiments, the rear chamber 50 is located on the side 44 of the pressure disc 40 opposite the pressure chamber 22 within the intermediate flange 25 and can be fluidly coupled to the ambient pressure such that there is a prevailing pressure difference between the rear chamber 50 and the pressure chamber 22. Thus, in some embodiments, due at least partly to the pressure chamber pressure which is greater than the rear chamber pressure, the pressure disc 40 may be subjected to a compressive force directed in the direction of conveyance F. As a result, the carrier shaft 30 may be affected on the one hand by the compressive force directed against the direction of conveyance F acting on the transport element 32, and on the other by the compressive force directed in the direction of conveyance F acting on the pressure disc 40. Due to the axially fixed bearing of the pressure disc 40 on the carrier shaft 30, a corresponding force component in the direction of the arrow F may be exerted on the carrier shaft 30. In some embodiments, the effective axial load of the carrier shaft 30 is therefore reduced or eliminated by the configuration of the pressure disc 40.

A bearing or slide bearing 80 may be positioned between the pressure disc 40 and the conveyance housing 20. In some embodiments, the pressure disc 40 is thus slidably supported within the conveyance housing 20, more precisely within the shoulder in the intermediate flange 25, which is part of the conveyance housing 20. In the illustrated embodiment, the rear chamber 50 may be connected to the suction chamber 16 via a recirculation line 70, via which the medium, which has passed into the rear chamber 50 due to leakage, may be re-supplied to the suction chamber 16. Thus, in some embodiments, the chamber 50 is at least the pressure of the suction chamber 16.

In an inverted direction of rotation and direction of conveyance F, the medium in FIG. 8 is conveyed to the left, and the pressure chamber may then be positioned in the region of the original inlet. In this example, the recirculation line 70 may serve as a pressure line for conveying medium that has been subjected to the pressure chamber pressure into the original rear chamber to subject the pressure disc to a compressive force directed in the new direction of conveyance.

Figure 2:
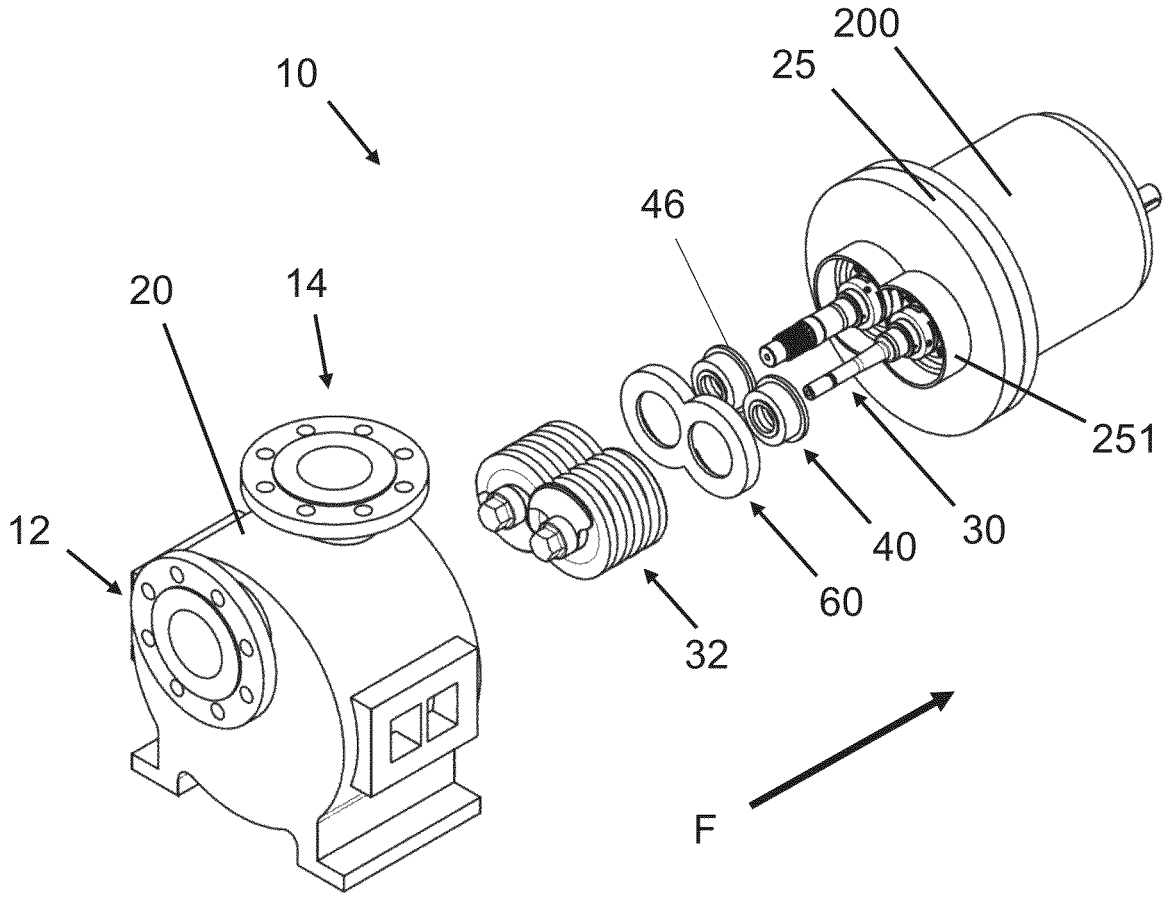
FIG. 2 illustrates an exploded perspective view of the pump of FIG. 1, according to some embodiments.

FIG. 2 shows an exploded view of a pump 10 according to some embodiments. In some embodiments, the pump 10 includes a conveyance housing 20 having the inlet 12, the outlet 14, and the intermediate flange 25. The bearing housing 200 may be positioned behind the intermediate flange 25 on the conveyance housing 20 in the direction of conveyance F. In some embodiments in an assembled state of the pump 10, the conveyance housing 20 and the bearing housing 200 are fixedly connected to one another. The intermediate flange 25 forms part of the conveyance housing 20. In some embodiments, the direction of conveyance F can be reversed, which can be accomplished by reversing the direction of rotation of the drive or a switching of a gear. In the reverse configuration, the outlet is then the inlet, the inlet is the outlet, and the force directions are inverted accordingly. The pressure disc may also be subjected to a compressive force acting in the direction of conveyance, albeit away from the outer bearing, such that a flow line from the pressure chamber to the side of the pressure disc facing away from the transport element conducts the medium towards the pressure disc.

In the embodiment illustrated in FIG. 2, two carrier shafts 30 are supported in and project out of the bearing housing 200 towards the conveyance housing 20. For example, the pump 10 may be a double spindle pump and/or double screw pump. In some embodiments, the pump may be a single spindle pump and/or single screw pump. Following the direction of conveyance F, two transport elements 32 in the form of a pair of mandrel screw spindles, two pressure rings 60 in the form of a single-piece double ring, and two pressure discs 40 are arranged on the carrier shaft 30. The two pressure rings 60 joined together to form the double ring each have a bore or recess having an inner diameter corresponding to the front-facing outer diameter of the pressure disc 40. In some embodiments, at side 44 of the pressure disc 40 facing the rear chamber 50 shown in FIG. 3, a shoulder 46 may be formed, which projects radially outward and serves as a counter-bearing for the two pressure rings 60. The joining of the two pressure rings 60 into a double ring increases the surface region on which the conveyed medium can act with the conveyance pressure of the pressure chamber 22. In some embodiments, the two separate pressure discs 40 can rotate together with the carrier shaft 30 and are supported against the static pressure rings 60. In the assembled state, the double ring may be inserted within a correspondingly shaped protrusion or shoulder 251 on the intermediate flange 25 and supported in an axially slidable and rotationally fixed manner.

Figure 3:
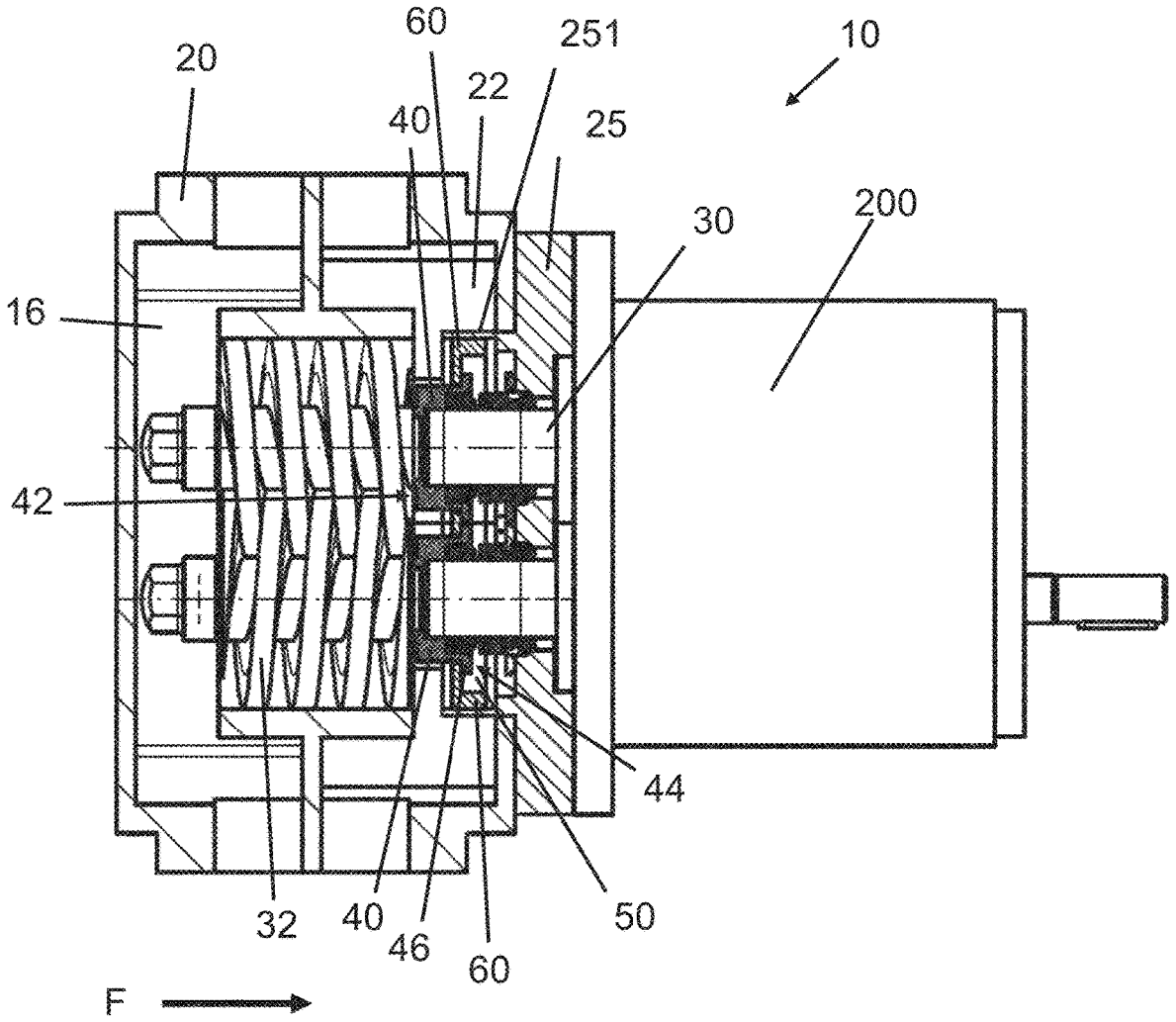
FIG. 3 illustrates a cross-sectional view through the pump of FIG. 1, according to some embodiments.

FIG. 3 shows a cross-sectional view through an assembled pump 10 of FIG. 1. The inlet 12 and the outlet 14 cannot be seen in the cross-sectional view shown, due to the horizontally arranged cross-sectional plane. In some embodiments, a suction chamber 16 and a pressure chamber 22 are positioned within the conveyance housing 20. Two carrier shafts 30 may be rotatably supported in the conveyance housing 20. On the axle-parallel to the carrier shafts 30, respective transport elements 32 in the form of mandrel screw spindles are positioned, which are arranged so as to run counter to one another and have the same slope. In some embodiments, a medium is conveyed along the direction of conveyance F from the suction chamber 16 into the pressure chamber 22 via the transport element 32. In the direction of conveyance F behind the transport element 32, a pressure disc 40 is positioned and axially fixed on the carrier shaft 30. For example, the pressure disc 40 may be connected to the carrier shaft 30 by way of a feather key, a feather gearing, an interference fit, gluing, soldering, or welding. In some embodiments, it is also possible for the pressure disc 40 to be molded in one piece with the carrier shaft 30.

The pressure disc 40 comprises a side 42 facing the pressure chamber 22 and a side 44 facing away from the pressure chamber. The side 42 facing the pressure chamber may be fluidly connected to the pressure chamber 22, while the side 44 facing away from the pressure chamber may be fluidly connected to a rear chamber 50. In some embodiments, the pressure chamber 22 has a pressure chamber pressure that is greater than the rear chamber pressure. In FIG. 3, a pressure ring 60, or the double ring, is arranged between the pressure disc 40 and the conveyance housing 20 in the shoulder 251. The pressure ring 60 may be supported by a side of a shoulder 46 of the pressure disc 40 facing the pressure chamber 22. In the example shown, the pressure rings 60 are formed as a single-piece double ring. In some embodiments, each one of the pressure rings 60 are separate components. A side of the pressure rings 60 facing the pressure chamber 22 may be fluidly connected to the pressure chamber 22. In some embodiments, a side of the pressure rings 60 facing away from the pressure chamber 22 may be fluidly connected to the rear chamber 50. The rear chamber 50 may be fluidly connected to the suction chamber 16, for example, via the recirculation line 70 shown in FIG. 8. In some embodiments, the pressure rings 60 allow a further reduction of the effective axial load of the carrier shafts 30, because, in addition to the pressure discs 40, the pressure rings 60 experience an axial load through the pressure chamber pressure, which is transferred to the carrier shaft 30 via the pressure discs 40 and is directed against the axial load transferred by the transport elements 32 to the carrier shafts 30.

Figure 4:
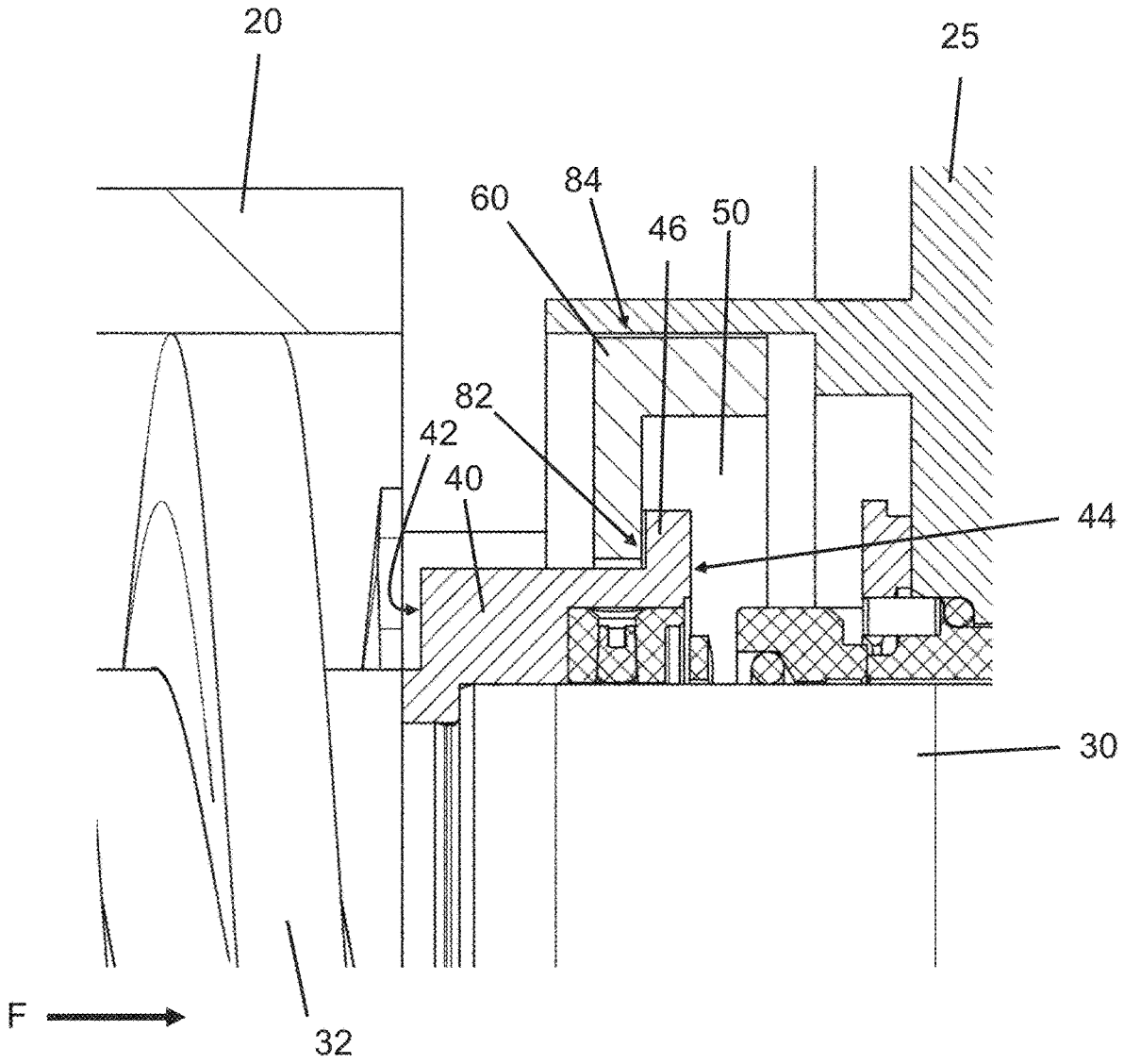
FIG. 4 illustrates a detailed sectional view of the pump of FIG. 1, according to some embodiments.

FIG. 4 illustrates a detailed view of the pressure discs 40 in the cross-sectional view of FIG. 1. Between the pressure rings 60 and the shoulder 46 of the pressure disc 40, a bearing or slide bearing 82 may be configured in the form of an axial bearing. Between the pressure rings 60 and the intermediate flange 25, a bearing or slide bearing 84 may be configured in the form of a radial bearing. In some embodiments, the pressure rings 60 are not rotatably supported in the intermediate flange 25. Axial forces may be absorbed by the plain bearing 82 formed as the axial bearing between the pressure rings 60 and the shoulder 46 of the pressure disc 40. An inwardly projecting shoulder of the pressure disc 40 may transfer the axial forces to the carrier shaft 30. In the axial direction, the rear chamber 50 is configured in the direction of conveyance F behind the pressure disc 40 and the pressure rings 60. In some embodiments, sealing elements are used in order to seal the rear chamber 50 against the bearing housing 200 so that medium that can pass through the slide bearings cannot enter the bearing housing 200. In some embodiments, a fluid connection of the rear chamber 50 to the environment or the suction chamber 16 is provided.

Figure 5:
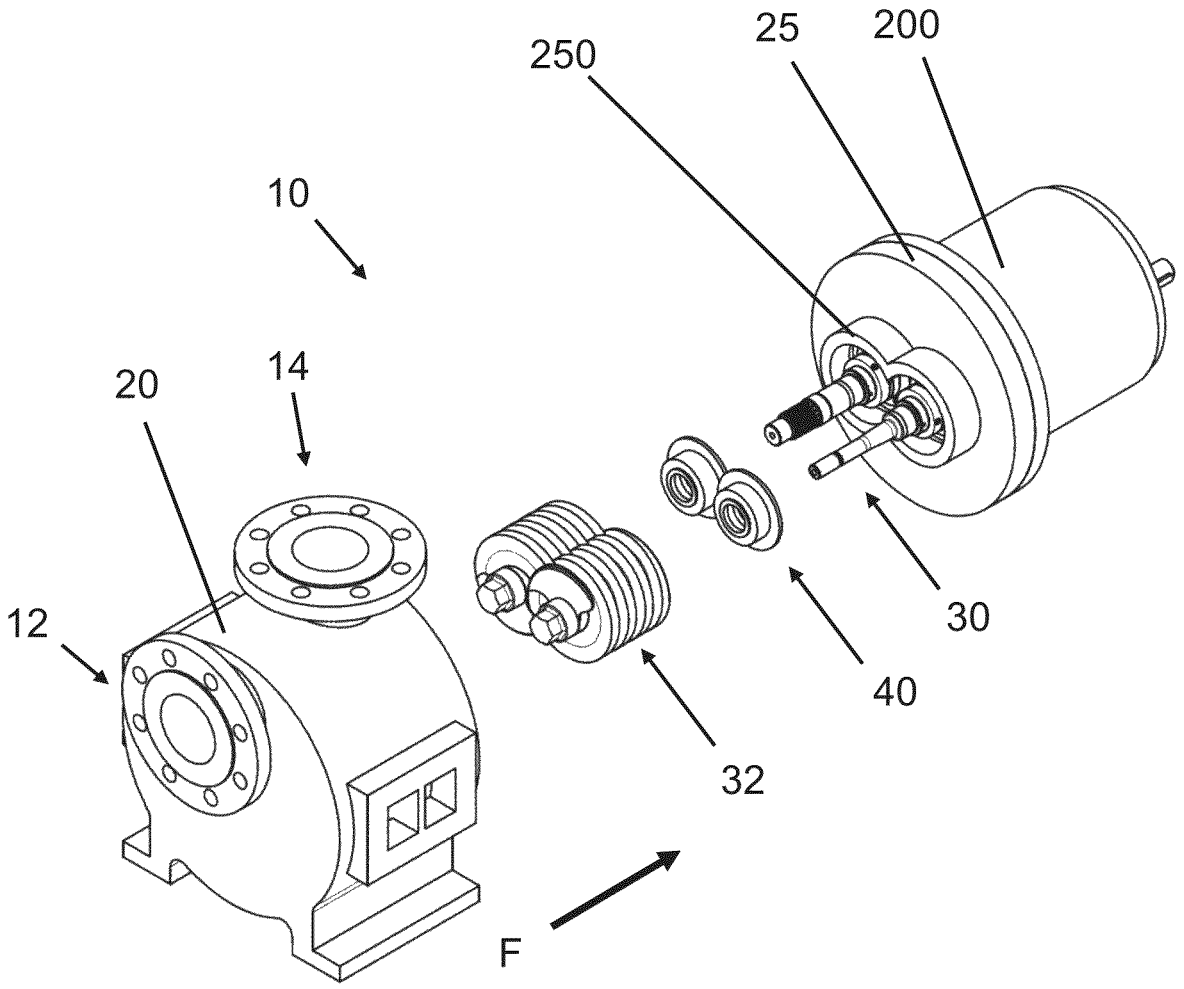
FIG. 5 illustrates an exploded view of a pump according to some embodiments.

FIG. 5 illustrates an exploded view of a pump 10 according to some embodiments. The pump 10 includes a conveyance housing 20 having an intermediate flange 25 and a bearing housing 200 arranged behind the conveyance housing 20 in the direction of conveyance F. In the illustrated embodiment, two carrier shafts 30 are supported in and project outwardly from the bearing housing 200 towards the conveyance housing 20. Following the direction of conveyance F, two transport elements 32 in the form of a pair of mandrel screw spindles and two separate, round pressure discs 40 are arranged on the carrier shaft 30.

Figure 6:
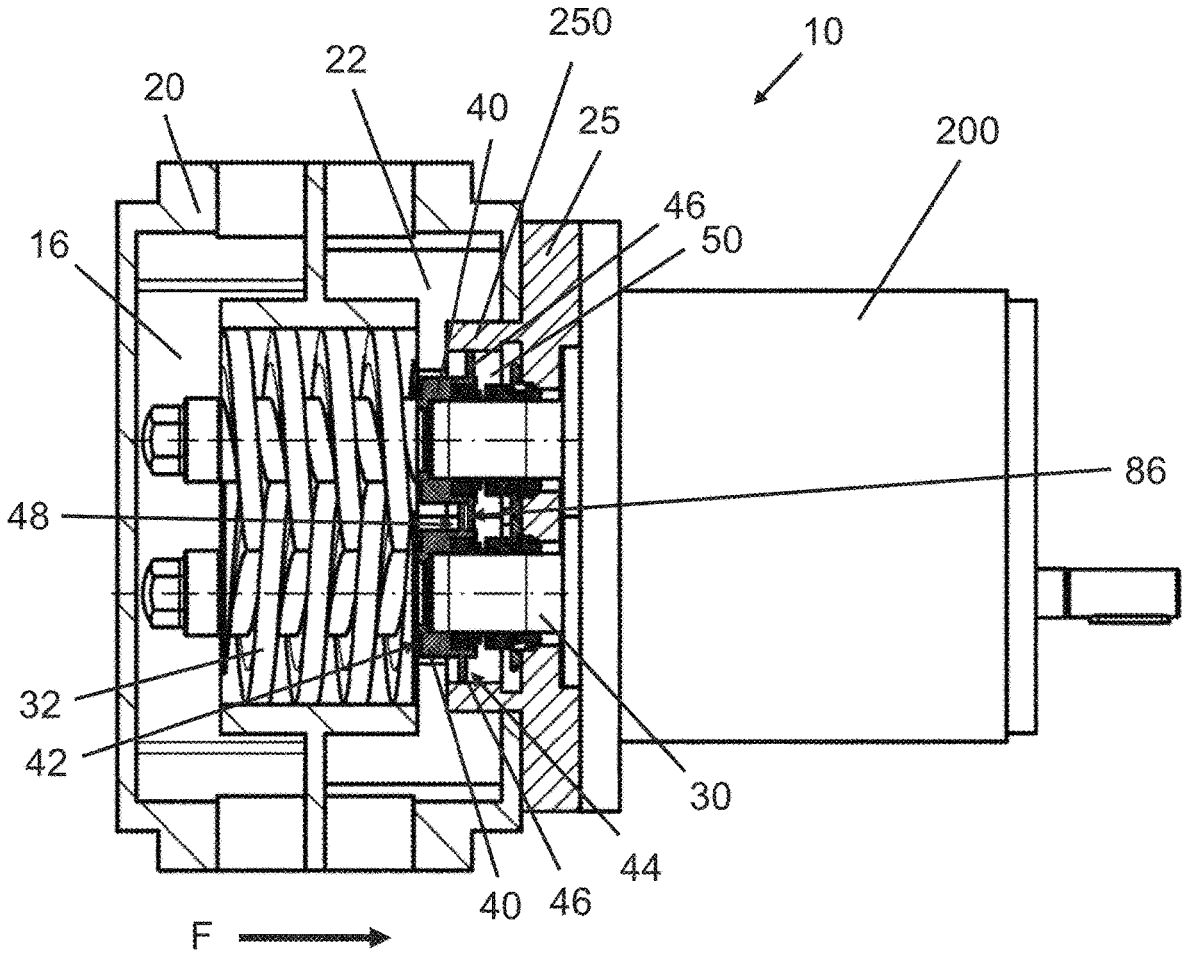
FIG. 6 illustrates a cross-sectional view of the pump of FIG. 5, according to some embodiments.

FIG. 6 illustrates a cross-sectional view through a pump 10 of FIG. 5. In some embodiments, in the conveyance housing 20, the two carrier shafts 30 are rotatably supported in the liner or bore. A transport element 32 in the form of a mandrel screw spindle may be positioned on the axle-parallel carrier shafts 30. In some embodiments, the transport elements 32 convey the medium along the direction of conveyance F from the suction chamber 16 into the pressure chamber 22. In the direction of conveyance F behind the transport element 32, a pressure disc 40 may be positioned and axially fixed on the carrier shaft 30. The pressure discs 40 each may have a side 42 facing the pressure chamber and a side 44 facing away from the pressure chamber. The side 42 facing the pressure chamber may be fluidly connected to the pressure chamber 22, while the side 44 facing away from the pressure chamber may be fluidly connected to a rear chamber 50 that is connected to the suction chamber 16, either by the environment or by the recirculation line 70.

In some embodiments, the pressure discs 40 each include corresponding shoulders 46 that are axially offset from one another, which may be achieved by an axially offset arrangement of the pressure discs 40. The outer diameter of the shoulders 46 has dimensions such that the greatest possible overlapping of the shoulders 46 occurs. The shoulder 46 of the lower pressure disc 40, in the illustrated embodiment, radially overlaps the shoulder 46 of the upper pressure disc 40 in an overlapping region 48. In the overlapping region 48, a slide bearing 86 is configured between the two shoulders 46 of the pressure discs 40 so that leaks between the two pressure discs 40 are prevented or at least reduced.

Figure 7:
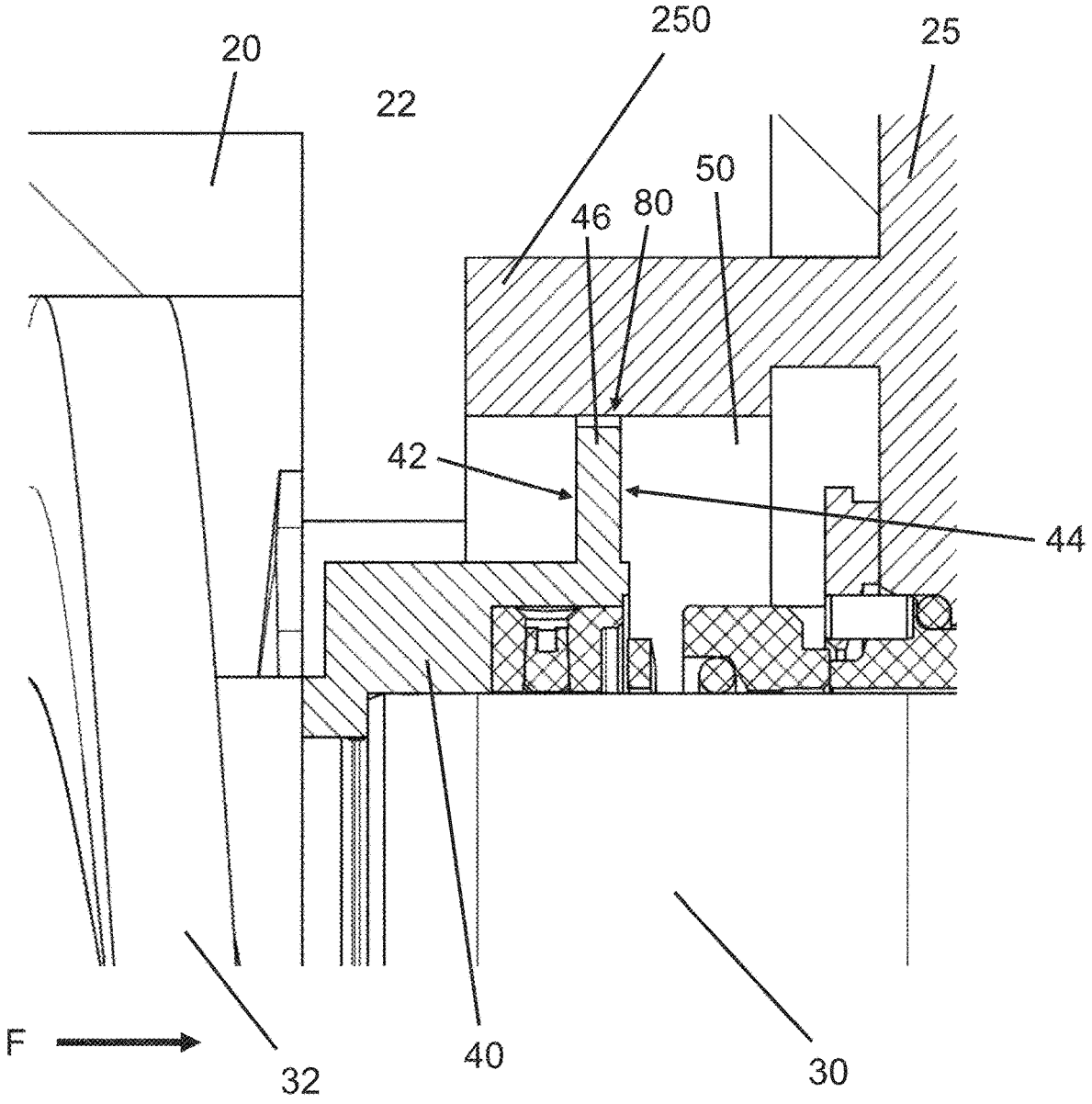
FIG. 7 illustrates a detailed sectional view of pump of FIG. 5, according to some embodiments.

FIG. 7 illustrates a detailed view of the sectional view of a pump 10 of FIG. 5. Between the shoulders 46 of the pressure discs 40 and the conveyance housing 20 or the shoulder 250 of the intermediate flange 25, a respective slide bearing 80 is configured in the form of a radial bearing. In some embodiments, the pressure differences between the sides 42, 44 of the pressure discs 40 and the axial support on the carrier shafts 30 reduce the axial load on the bearings.

What is claimed:

1. A pump comprising:

a suction-side inlet;

a pressure-side outlet;

a suction chamber;

a conveyance housing comprising a pressure chamber, wherein the pressure chamber operates at a first pressure;

a first carrier shaft and a second carrier shaft positioned in the conveyance housing;

a first transport element connected to the first carrier shaft, and a second transport element connected to the second carrier shaft, wherein the first and second transport elements are configured to convey a medium from the suction chamber into the pressure chamber; and a first pressure disc and a second pressure disc, wherein the first pressure disc is axially fixed to the first carrier shaft and the second pressure disc is axially fixed to the second carrier shaft, wherein a corresponding first side of the first pressure disc has a first base body and a first shoulder and a corresponding first side of the second pressure disc has a second base body and a second shoulder, wherein the first and second base bodies and the first and second shoulders are fluidly connected to the pressure chamber and exposed to a compressive force acting in a direction of conveyance, wherein the first shoulder is axially offset from the second shoulder, and the first and second shoulders radially overlap in an overlapping region.

2. The pump of claim 1, wherein a second side of each of the first and second pressure discs distal to the pressure chamber is fluidly connected to a rear chamber, wherein the rear chamber operates at a second pressure that is less than the first pressure.

3. The pump of claim 2, wherein the rear chamber is fluidly connected to the suction chamber.

4. The pump of claim 1, wherein a slide bearing is positioned between each of the first and second pressure discs and the conveyance housing.

5. The pump of claim 4, wherein the slide bearing of the first pressure disc is positioned between the first shoulder and the conveyance housing, and the slide bearing of the second pressure disc is positioned between the second shoulder and the conveyance housing.

6. The pump of claim 1, wherein a first pressure ring is positioned radially between the first pressure disc and the conveyance housing, the first pressure ring is supported by the first side of the first shoulder of the first pressure disc proximal to the pressure chamber, and a second pressure ring is positioned radially between the second pressure disc and the conveyance housing, wherein the second pressure ring is supported by the first side of the second shoulder of the second pressure disc proximal to the pressure chamber.

7. The pump of claim 6, wherein a portion of each of the first and second pressure rings extends over a radial edge of the respective first and second shoulder of the corresponding first and second pressure disc.

8. The pump of claim 1, wherein the first pressure disc is positioned on the first carrier shaft and connected in a friction-locking, positively-locking, and/or materially-locking manner, and the second pressure disc is positioned on the second carrier shaft and connected in a friction-locking, positively-locking, and/or materially-locking manner.

9. The pump of claim 1, wherein each of the first and second pressure discs and the corresponding first and second carrier shafts are molded as one piece.

10. The pump of claim 1, wherein the first and second carrier shafts are partially positioned outside of the pressure chamber within a bearing housing, wherein the bearing housing is fixed to the conveyance housing.

11. The pump of claim 1, wherein the pump is a single-fluted mandrel screw spindle pump.

12. The pump of claim 1, wherein the first and second pressure discs are positioned in the direction of conveyance behind the corresponding first and second transport elements.

13. A pump comprising:

a suction-side inlet;

a pressure-side outlet;

a suction chamber;

a conveyance housing comprising a pressure chamber;

a first carrier shaft and a second carrier shaft positioned in the conveyance housing;

a first threaded fluid transport connected to the first carrier shaft, and a second threaded fluid transport connect to the second carrier shaft, the first and second threaded fluid transports fluidly connected to the suction chamber and the pressure chamber to convey a fluid from the suction chamber into the pressure chamber upon rotation of the first and second threaded fluid transports; and a first pressure disc arranged with the first carrier shaft extending therethrough and a second pressure disc arranged with the second carrier shaft extending therethrough, such that a first side of the first pressure disc comprises a first base body and a first shoulder and a corresponding first side of the second pressure disc has a second base body and a second shoulder, and wherein the first and second base bodies and the first and second shoulders are fluidly connected to the pressure chamber and exposed to a compressive force, wherein the first shoulder is axially offset from the second shoulder, and the first and second shoulders radially overlap in an overlapping region.

14. The pump of claim 13, wherein a second side of each of the first and second pressure discs distal to the pressure chamber is fluidly connected to a rear chamber, wherein the rear chamber operates at a second pressure that is less than a first pressure corresponding to the pressure chamber.

15. The pump of claim 14, wherein the rear chamber is fluidly connected to the suction chamber.

16. The pump of claim 13, wherein the pump further comprises a first pressure ring that is positioned radially between the first pressure disc and the conveyance housing and a second pressure ring that is positioned radially between the second pressure disc and the conveyance housing, the first and second pressure rings supported by the first side of the respective first and second shoulder of the corresponding first and second pressure disc proximal to the pressure chamber.

17. The pump of claim 13, wherein the pump further comprises a pressure ring configured as a double ring that corresponds to two of the first and second pressure discs.

18. A pump comprising:

a suction-side inlet;

a pressure-side outlet;

a suction chamber;

a conveyance housing comprising a pressure chamber, wherein the pressure chamber operates at a first pressure;

a carrier shaft positioned in the conveyance housing;

a transport element connected to the carrier shaft, wherein the transport element is configured to convey a medium from the suction chamber into the pressure chamber;

a pressure disc, wherein the pressure disc is axially fixed to the carrier shaft, wherein a first side of the pressure disc comprises a base body and a shoulder, wherein the base body and the shoulder are fluidly connected to the pressure chamber and exposed to a compressive force acting in a direction of conveyance; and a pressure ring positioned radially between the pressure disc and the conveyance housing, the pressure ring supported by the first side of the shoulder of the pressure disc proximal to the pressure chamber, wherein a portion of the pressure ring extends over a radial edge of the shoulder of the pressure disc.

* * * * *